US011788524B2

(12) United States Patent
Klaus et al.

(10) Patent No.: US 11,788,524 B2
(45) Date of Patent: Oct. 17, 2023

(54) COOLING ARRANGEMENT AND METHOD FOR COOLING AN AT LEAST TWO-STAGE COMPRESSED AIR GENERATOR

(71) Applicant: Gardner Denver Deutschland GMBH, Bad Neustadt (DE)

(72) Inventors: Frank Georg Klaus, Zell-Barl (DE); Ulrich Thomes, Kulz (DE); Marc Schiel, Heinzenbach (DE)

(73) Assignee: Gardner Denver Deutschland GMBH, Bad Neustadt (DE)

( * ) Notice: Subject to any disclaimer, the term of this patent is extended or adjusted under 35 U.S.C. 154(b) by 158 days.

(21) Appl. No.: 17/426,875

(22) PCT Filed: Jan. 24, 2020

(86) PCT No.: PCT/EP2020/051751
§ 371 (c)(1),
(2) Date: Jul. 29, 2021

(87) PCT Pub. No.: WO2020/156942
PCT Pub. Date: Aug. 6, 2020

(65) Prior Publication Data

US 2022/0106954 A1 Apr. 7, 2022

(30) Foreign Application Priority Data

Jan. 30, 2019 (DE) ..... 102019102387.4

(51) Int. Cl.
*F04B 39/06* (2006.01)
*F04B 41/06* (2006.01)
(Continued)

(52) U.S. Cl.
CPC ..... *F04B 39/066* (2013.01); *F04B 39/06* (2013.01); *F04B 41/06* (2013.01); *F04B 53/08* (2013.01);
(Continued)

(58) Field of Classification Search
CPC ..... F04B 39/06; F04B 39/066; F04B 41/06; F04B 53/08; F04C 18/16; F04C 23/001; F04C 29/04; F04C 2210/221
See application file for complete search history.

(56) References Cited

U.S. PATENT DOCUMENTS 5,481,880 A 1/1996 Guillard et al.
9,976,569 B2 5/2018 Janssens
(Continued)

FOREIGN PATENT DOCUMENTS

CN 1104724 A 7/1995
CN 104100494 A 10/2014
(Continued)

OTHER PUBLICATIONS

Office Action in China for Application No. 202080021900.8, dated Oct. 27, 2022.
(Continued)

*Primary Examiner* — Loren C Edwards
(74) *Attorney, Agent, or Firm* — Kevin E. West; Advent, LLP

(57) ABSTRACT

A cooling arrangement for an at least two-stage compressed air generator. The cooling arrangement comprises an intercooler arranged between a first and a second compressor stage, an aftercooler arranged after the second compressor stage, and a subassembly cooler, which absorbs heat from further subassemblies of the compressed air generator. A coolant circuit comprises a main cooler, the cold side supplying a cooled coolant parallel to the respective coolant inlet of the intercooler, of the aftercooler and of the subassembly cooler, and the hot side receiving the heated coolant exiting in parallel at the respective coolant outlet of the intercooler and of the aftercooler. The coolant outlet of the
(Continued)

subassembly cooler is connected to a feed inlet of the intercooler and/or of the aftercooler.

10 Claims, 2 Drawing Sheets

(51) Int. Cl.

| | |
|---|---|
| ***F04B 53/08*** | (2006.01) |
| ***F04C 18/16*** | (2006.01) |
| ***F04C 23/00*** | (2006.01) |
| ***F04C 29/04*** | (2006.01) |

(52) U.S. Cl.
CPC ..... *F04C 18/16* (2013.01); *F04C 23/001* (2013.01); *F04C 29/04* (2013.01); *F04C 2210/221* (2013.01)

(56) References Cited

U.S. PATENT DOCUMENTS

| | | | | |
|---|---|---|---|---|
| 10,677,236 | B2 | 6/2020 | Huetter | |
| 10,816,001 | B2 | 10/2020 | Klaus et al. | |
| 2004/0101411 | A1 | 5/2004 | Nichol | |
| 2008/0127665 | A1 | 6/2008 | Fournier | |
| 2011/0000227 | A1* | 1/2011 | Kamiya | F04C 29/04 62/505 |
| 2018/0258952 | A1 | 9/2018 | Meeusen et al. | |

FOREIGN PATENT DOCUMENTS

| | | | |
|---|---|---|---|
| CN | 104179663 | A | 12/2014 |
| CN | 106089659 | A | 11/2016 |
| DE | 3134844 | A1 | 7/1982 |
| DE | 60117821 | T2 | 11/2006 |
| DE | 102017107602 | B3 | 9/2018 |
| EP | 2529116 | B1 | 11/2013 |
| EP | 2886862 | A1 | 6/2015 |
| JP | H07217579 | A | 8/1995 |
| WO | 2015172206 | A9 | 1/2016 |
| WO | 2018054854 | A1 | 3/2018 |

OTHER PUBLICATIONS

Office Action in India for Application No. 202117037051, dated Dec. 2, 2022.
International Preliminary Report on Patentability and Written Opinion for PCT/EP2020/051751, dated Jul. 27, 2021.
PCT International Search Report and Written Opinion for PCT/EP220/051751, dated Mar. 27, 2020.

* cited by examiner

COOLING ARRANGEMENT AND METHOD FOR COOLING AN AT LEAST TWO-STAGE COMPRESSED AIR GENERATOR

The invention relates to a cooling arrangement for an at least two-stage compressed air generator. Such a compressed air generator, also called a compressor, comprises a liquid-cooled intercooler, which is arranged between a first and a second compressor stage, in order to cool the precompressed air discharged from the first compressor stage before it enters the second compressor stage, and a liquid-cooled aftercooler, which is arranged after the second compressor stage, in order to cool the air compressed by it. Furthermore, a liquid-cooled subassembly cooler is provided, which absorbs heat from further subassemblies of the compressed air generator, in order to cool power electronics or drives and gears of the compressor stages, for example. A coolant circuit runs via a main cooler, the cold side of which supplies a coolant to the respective coolant inlet of the intercooler, of the aftercooler and of the subassembly cooler, and the hot side of which receives the heated coolant exiting at the coolant outlet of the intercooler and of the aftercooler.

The invention furthermore relates to a method for cooling an at least two-stage compressed air generator.

In general, compressor plants of this type always require the dissipation of more or less large amounts of heat, in order to avoid overheating of individual components or of the entire plant. Up to now, the entire plant has been regularly cooled by cooling air, with heated exhaust air usually being discharged unused into the environment. The heat is then either lost or can only be recovered inefficiently from the exhaust air. Some plants additionally contain a heat exchanger, the secondary heat transport medium of which absorbs heat from a primary cooling circuit of the compressor and transports it away. The dissipated heat can then be used by an external consumer.

The present disclosure describes on the one hand, ensuring efficient cooling of such compressed air generators (compressor plants), while reducing the equipment-related outlay, and on the other hand also in permitting more efficient recovery of heat with respect to the entire compressed air generator.

This is accomplished by a cooling arrangement for an at least two-stage compressed air generator according to example embodiments of the present disclosure. Preferred embodiments of the cooling arrangement are specified herein. Furthermore, the object is accomplished by a method for cooling an at least two-stage compressed air generator according to the present disclosure. Advantageous versions of the method are specified below.

The cooling arrangement according to the invention is suitable for cooling a compressed air generator, preferably in the manner of a compressor plant, with at least two compressor stages. The cooling arrangement comprises at least one liquid-cooled intercooler, which is arranged between a first and a second compressor stage, in order to cool the precompressed air discharged from the first compressor stage before it enters the second compressor stage. A liquid-cooled aftercooler is arranged after the second, or last, compressor stage, in order to cool the further compressed air. In the simplest case, the generated compressed air is provided to external units after flowing through the aftercooler. In variations, the compressed air generator can also have more than two compressor stages and correspondingly additional intercoolers.

Furthermore, the cooling arrangement comprises a liquid-cooled subassembly cooler, which absorbs heat from further subassemblies of the compressed air generator and discharges it to the coolant. Like the other coolers, the subassembly cooler is arranged in the housing of the compressed air generator and is formed, for example, as a finned cooler, cooling plate, heat pipe or the like. The subassembly cooler can be composed of a plurality of individual coolers and serves to dissipate heat in particular from the drives of the compressor stages and the power electronics that are required for controlling the compressed air generator.

The cooling arrangement has a coolant circuit, which comprises a main cooler in order to dissipate the heat, which is absorbed by the coolant in the other coolers, out of the compressed air generator. The cold side of the main cooler delivers cooled coolant at a low temperature directly to the respective coolant inlet of the intercooler, of the aftercooler and of the subassembly cooler. The coolant inlets of the intercooler(s), aftercooler and subassembly cooler(s) are connected in parallel, such that the coolant is fed to them at the same low temperature. The hot side of the main cooler receives the heated coolant directly from the respective coolant outlet of the intercooler (or the plurality of intercoolers) and of the aftercooler, or indirectly from these if a heat exchanger is interposed for heat recovery, as described further below. The coolant outlets of the intercooler(s) and the aftercooler are connected in parallel and deliver the heated coolant at a high temperature to the main cooler, where appropriate via the heat exchanger.

In example embodiments, the coolant outlet of the subassembly cooler is not connected parallel to the coolant outlet of the intercooler or aftercooler. This prevents the coolant from being cooled from the high temperature at the outlet of the intercooler and aftercooler by the admixture from the subassembly cooler, since the subassembly cooler regularly delivers lower temperatures of coolant, owing to the smaller amount of heat to be dissipated. Instead, the coolant of the subassembly cooler is fed to a feed inlet of the intercooler and/or the aftercooler, the feed inlet being arranged between the coolant inlet and the coolant outlet, at a position at which the intermediate temperature of the coolant in the intercooler or aftercooler corresponds to the exit temperature of the coolant at the subassembly cooler ±20%. Preferably, the temperature of the coolant admixed from the subassembly cooler deviates by less than ±10%, in particular by less than ±3%, from the temperature at the point of admixture in the intercooler or aftercooler.

The same cooling medium (preferably water) is thus used for the intercooler, the aftercooler and the subassembly cooler. Thus, not only heat from the compressed air but also the heat from subassemblies, e.g. electric motors, converters, compressor stages, gear units etc. can be accumulated in the coolant and transported away from it. The majority of the waste heat from the entire compressed air generator is thus also available for heat recovery.

A further advantage of the invention is that the main cooler can be designed to be significantly smaller, which leads to a considerable reduction in the size of the coolant circuit and thus in the overall costs of the compressed air generator. Owing to the described targeted feeding of the coolant delivered from the subassembly cooler at the intermediate temperature into the intercooler and/or aftercooler, the high temperature at the outlet of the intercooler and the aftercooler can be kept at a high level, preferably in the region of 90° C. This leads to a large temperature difference at the main cooler, such that its cooling area can be kept smaller than if the inlet temperature at the main cooler were lower. The required cooling area is proportional to the temperature difference between the inlet temperature (high temperature) and the desired outlet temperature (low temperature).

According to an advantageous embodiment, the coolant delivered from the subassembly cooler is fed both to the intercooler and to the aftercooler via the respective feed inlet.

According to a particularly preferred embodiment of the cooling arrangement, a heat exchanger is interposed in the coolant circuit between the respective coolant outlet of the intercooler and of the aftercooler and the coolant inlet of the main cooler. The heat exchanger thus has all the heat that is fed to the coolant available for transfer to a heat carrier medium.

Preferably, the main cooler is a water-air cooler or a water-water cooler or a combination cooler, which uses water and air optionally as a cooling medium. The user of the compressed air generator is therefore free to decide whether to implement the main cooling with the aid of fan-assisted exhaust air cooling or by connecting to an external liquid cooling medium.

It is advantageous if the intercooler and/or the aftercooler have a plurality of feed inlets, to which the coolant optionally can be fed from the coolant outlet of the subassembly cooler. In particular, a distributor unit is arranged between the coolant outlet of the subassembly cooler and the feed inlets, which distributor unit supplies, in a temperature-controlled manner, that feed inlet at which the intermediate temperature of the coolant in the intercooler or aftercooler is closest to the exit temperature of the coolant at the subassembly cooler.

The intercooler, the aftercooler, the subassembly cooler, the heat exchanger, the first and second compressor stages and an electronic control unit are conveniently arranged within a common device housing. The cooling arrangement is thus an important constituent of the compressed air generator, such that the installation outlay for the user is kept to a minimum.

The method according to the invention for cooling an at least two-stage compressed air generator comprises the following steps:

- guiding a cooling medium in a coolant circuit through a main cooler and through a first liquid-cooled intercooler connected in series with the main cooler, which intercooler thus cools air precompressed by a first compressor stage;
- guiding the cooling medium in the coolant circuit through an aftercooler that is likewise connected in series with the main cooler and connected parallel to the intercooler, which aftercooler thus cools air post-compressed by a second compressor stage;
- feeding the cooling medium cooled in the main cooler to a liquid-cooled subassembly cooler, which absorbs heat from further subassemblies of the compressed air generator;
- feeding the heated cooling medium, which is discharged from the subassembly cooler, via a feed inlet into the intercooler and/or into the aftercooler, the feed taking place at a position in the intercooler or in the aftercooler at which the intermediate temperature of the coolant in the intercooler or aftercooler corresponds to the exit temperature of the coolant at the subassembly cooler ±20%, preferably these two temperatures are substantially the same.

Further advantages and details of the invention emerge from the following description of a preferred embodiment with reference to the drawings. In the drawings.

Figure 1:
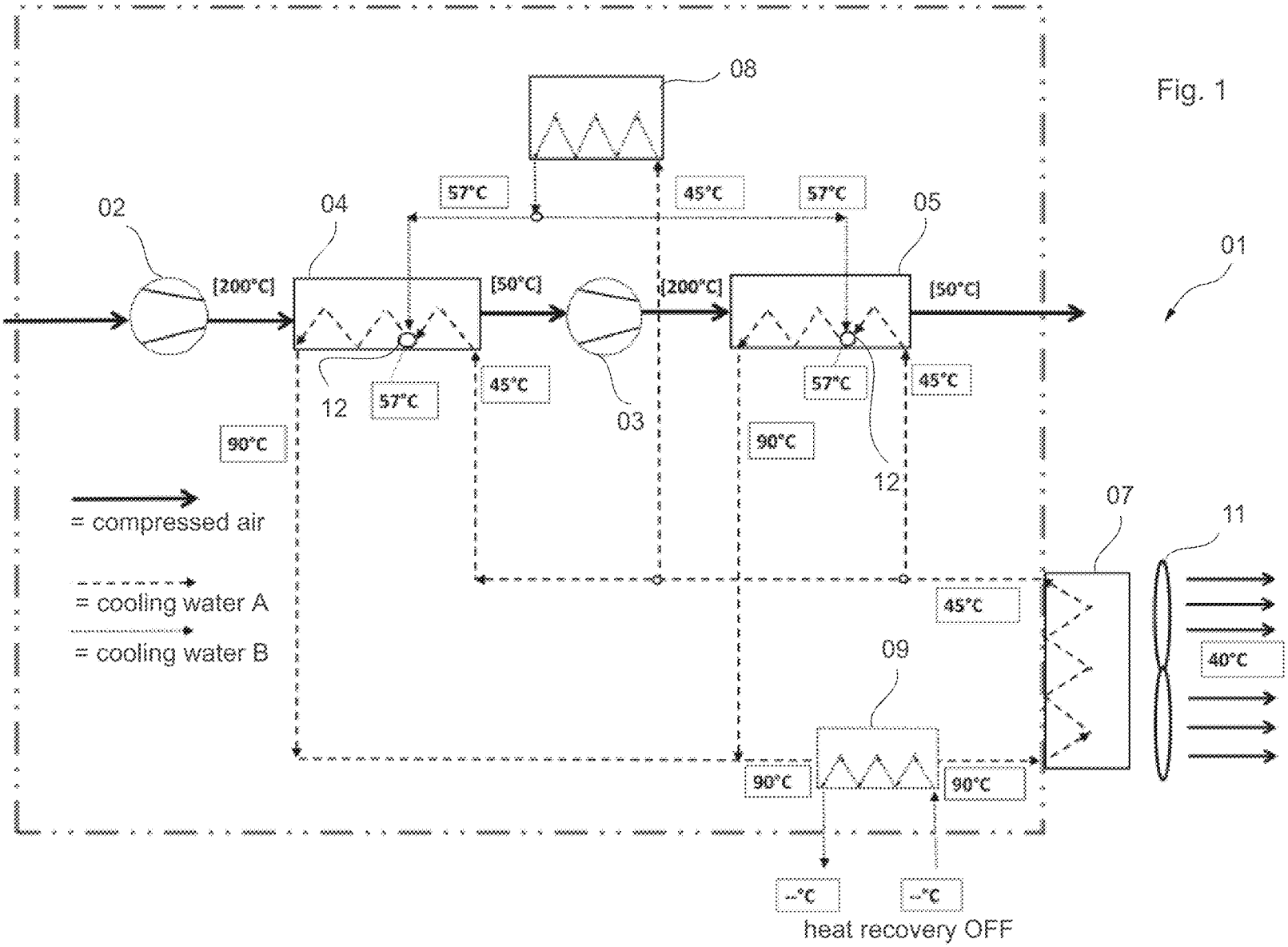
FIG. 1 shows a block diagram of a cooling arrangement according to the invention with deactivated heat recovery.

FIG. 1 shows the simplified block diagram of a compressed air generator 01 or a compressor plant. The block diagram mainly comprises the essential elements of a cooling arrangement and omits other units of the compressed air generator. The compressed air generator comprises at least a first compressor stage 02 and a second compressor stage 03. The air precompressed in the first compressor stage 01 is supplied at a temperature of, for example, 200° C. to an intercooler 04 for cooling and exits said intercooler 04 at approximately 50° C., in order to then be further compressed by the second compressor stage 03. The finally compressed air exits the second compressor stage 03 at a temperature of approximately 200° C. and is then fed to an aftercooler 05 for renewed cooling, so that the compressed air is finally delivered to external units at approximately 50° C. For the dissipation of heat, a main cooler 07 delivers a cooling medium, preferably cooling water, to its cold side at a temperature of 45° C., for example. The cooling water A is delivered at this low temperature parallel to the inflow of the intercooler 04, the aftercooler 05 and a subassembly cooler 08. The cooling water flows through the intercooler 04 and the aftercooler 05 to absorb the heat of the compressed air and is delivered back to the hot side of the main cooler 07 at a high temperature of 90° C. for example. Prior to this, in the depicted design, the cooling water flows through one more heat exchanger 09, which, however, is deactivated in FIG. 1, so that the cooling water temperature at the inlet and outlet of the heat exchanger 09 is virtually unchanged. The heat is discharged at the main cooler 07, in order to bring the cooling water back to a low temperature. The cooling is assisted, for example, by a fan 11, which discharges a heated exhaust air at a temperature of 40° C., for example.

A special feature of the cooling arrangement is that, after flowing through the subassembly cooler 08, the cooling water is not guided directly to the main cooler 07 or to the upstream heat exchanger 09 parallel to the cooling water of the intercooler and the aftercooler. Instead, the cooling water outlet of the subassembly cooler is connected in each case to a feed inlet 12 at the intercooler 04 and at the aftercooler 05. The feed inlet 12 can alternatively also be provided only at one of the two coolers 04, 05 and its position is selected such that an intermediate temperature of 57° C., for example, prevails there in the cooler 04, 05. The intermediate temperature is to correspond substantially to the outlet temperature of the cooling water B, which is delivered from the subassembly cooler 08. The cooling water B is thus admixed again with the cooling water A in the intercooler 04 and/or in the aftercooler 05 and further heated there to the high temperature.

Figure 2:
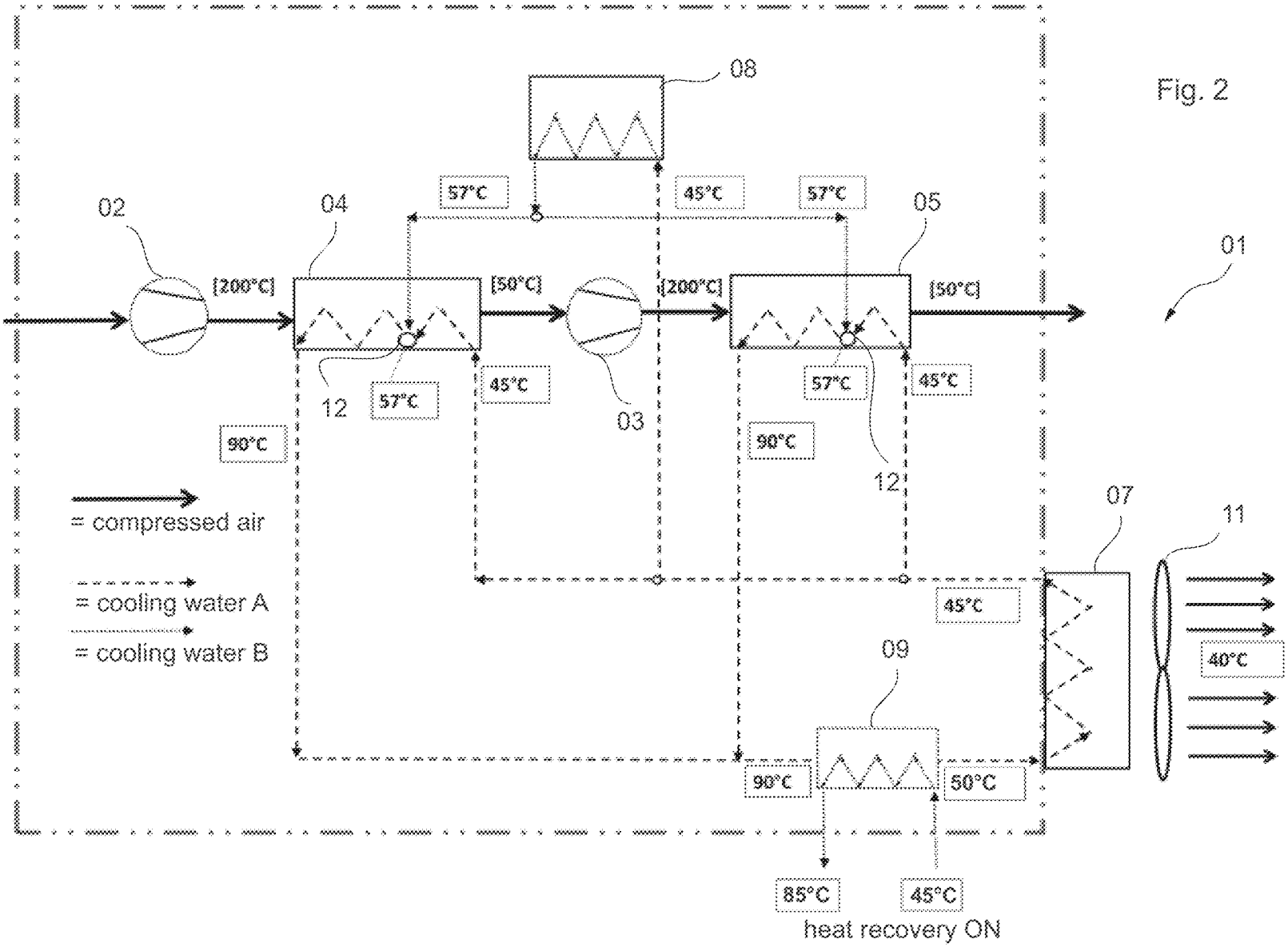
FIG. 2 shows a block diagram of the cooling arrangement with activated heat recovery.

FIG. 2 shows the simplified block diagram of the compressed air generator 01 or the compressor plant in a modified operating state, specifically with activated heat recovery at the heat exchanger 09. This results in a drop in the temperature of the heated cooling water from 90° C. to 50° C., for example, at the heat exchanger 09. The extracted heat is available for other applications, such as for heating purposes, for example.

LIST OF REFERENCE NUMBERS

01 compressed air generator/compressor plant
02 first compressor stage
03 second compressor stage

04 intercooler
05 aftercooler
06 -
07 main cooler
08 subassembly cooler
09 heat exchanger
10 -
11 fan
12 feed inlet

The invention claimed is:

1. An at least two-stage compressed air generator, comprising a liquid-cooled intercooler disposed between a first compressor stage and a second compressor stage for cooling precompressed air discharged from the first compressor stage before the precompressed air enters the second compressor stage;

a liquid-cooled aftercooler disposed after the second compressor stage for cooling air compressed by the second compressor stage;

a liquid-cooled subassembly cooler for absorbing heat from the compressed air generator;

a coolant circuit including a main cooler having a cold side and a hot side, the cold side configured to feed a cooled coolant having a low temperature respectively to a coolant inlet of the liquid-cooled intercooler, to a coolant inlet of the liquid-cooled aftercooler, and to a coolant inlet of the subassembly cooler in parallel, and the hot side configured to receive heated coolant having a high temperature which exits in parallel respectively at a coolant outlet of the liquid-cooled intercooler and at a coolant outlet of the liquid-cooled aftercooler, wherein a coolant outlet of the subassembly cooler is connected to at least one of a feed inlet of the liquid-cooled intercooler and a feed inlet of the liquid-cooled aftercooler, wherein the feed inlet of the liquid-cooled intercooler is disposed between the coolant inlet of the liquid-cooled intercooler and the coolant outlet of the liquid-cooled intercooler at a point at which an intermediate temperature of the coolant in the liquid-cooled intercooler is within twenty percent (±20%) of an exit temperature of the coolant at the subassembly cooler, and wherein the feed inlet of the liquid-cooled aftercooler is disposed between the coolant inlet of the liquid-cooled aftercooler and the coolant outlet of the liquid-cooled aftercooler at a point at which an intermediate temperature of the coolant in the liquid-cooled aftercooler is within twenty percent (±20%) of the exit temperature of the coolant at the subassembly cooler.

2. The compressed air generator according to claim 1, wherein a heat exchanger is disposed in the coolant circuit respectively between the coolant outlet of the liquid-cooled intercooler and the hot side of the main cooler, and the coolant outlet of the liquid-cooled aftercooler and the hot side of the main cooler.

3. The compressed air generator according to claim 1, wherein the main cooler is one of a water-air cooler, a water-water cooler, or a combination cooler, which uses water and air optionally as a cooling medium.

4. The cooling arrangement according to claim 3, wherein the main cooler comprises a fan.

5. The compressed air generator according to claim 1, wherein at least one of the liquid-cooled intercooler and the liquid-cooled aftercooler have a plurality of feed inlets, to which the coolant can be optionally fed from the coolant outlet of the subassembly cooler.

6. The compressed air generator according to claim 5, wherein a distributor unit is disposed between the coolant outlet of the subassembly cooler and the feed inlets of the plurality of feed inlets, wherein the distributor unit selectively supplies the plurality of feed inlets.

7. The compressed air generator according to claim 1, wherein at least the liquid-cooled intercooler, the liquid-cooled aftercooler, the subassembly cooler, a heat exchanger, the first compressor stage, the second compressor stage, and an electronic control unit are disposed within a common device housing.

8. A method for cooling an at least two-stage compressed air generator, comprising:

guiding a cooling medium in a coolant circuit through a main cooler and through an intercooler, the intercooler connected in series with the main cooler, and the intercooler cooling air precompressed by a first compressor stage;

guiding the cooling medium in the coolant circuit through an aftercooler, the coolant circuit through the aftercooler connected in series with the main cooler and the coolant circuit through the aftercooler connected in parallel to the intercooler, wherein the aftercooler cools air compressed by a second compressor stage;

feeding the cooling medium cooled in the main cooler to a liquid-cooled subassembly cooler, the subassembly cooler absorbing heat from the compressed air generator;

wherein the heated cooling medium exiting the subassembly cooler is fed into at least one of a feed inlet of the intercooler and a feed inlet of the aftercooler, and wherein the feed inlet of the intercooler is at a position in the intercooler at which an intermediate temperature of the coolant in the intercooler is within twenty percent (±20%) of an exit temperature of the coolant at the subassembly cooler, and the feed inlet of the aftercooler is at a position in the aftercooler at which an intermediate temperature of the coolant in the aftercooler is within twenty percent (±20%) of the exit temperature of the coolant at the subassembly cooler.

9. The method according to claim 8, wherein the cooling medium heated in the intercooler and in the aftercooler is fed to a heat exchanger for heat recovery before it is returned to the main cooler.

10. The method according to claim 8, wherein the heated cooling medium exiting the subassembly cooler is selectively fed via one of a plurality of feed inlets into at least one of the intercooler and the aftercooler.

* * * * *